United States Patent [19]

Anderson

[11] Patent Number: 4,893,938

[45] Date of Patent: Jan. 16, 1990

[54] CONTAINER SHAKING DEVICE

[76] Inventor: Hilda K. Anderson, P.O. Box 5103, Goose Creek, S.C. 29445

[21] Appl. No.: 320,601

[22] Filed: Mar. 8, 1989

[51] Int. Cl.[4] ..... B01F 11/00

[52] U.S. Cl. ..... 366/208; 366/239

[58] Field of Search ..... 366/605, 208, 209, 210, 366/211, 215, 219, 239, 53

[56] References Cited

U.S. PATENT DOCUMENTS

| | | | |
|---|---|---|---|
| 2,002,323 | 5/1935 | Kurz | 366/211 |
| 2,151,123 | 3/1939 | Lavine | 366/211 |
| 3,331,588 | 7/1967 | Nasser | 366/211 |
| 3,388,895 | 6/1968 | Ogren | 366/605 |

*Primary Examiner*—Robert W. Jenkins

*Attorney, Agent, or Firm*—Jerry T. Kearns

[57] ABSTRACT

A container shaking device especially for use in shaking nail polish containers includes a container holding portion mounted on a pivotal arm. An elongated reciprocal bar has a first end secured for pivoting the pivotal arm and has an elongated slot formed adjacent an opposite end. A rotary arm has a transverse pin received in the slot on the reciprocal arm and is connected through a plurality of gears for rotation by an electric motor. The container holder includes an L-shaped portion having a first leg secured to the pivotal arm and a clamping member mounted for sliding movement on the first leg member in parallel relation with a second leg member. A spring biased clamping pin is utilized for securing the clamping member in adjusted position for securing various different sizes of containers.

7 Claims, 4 Drawing Sheets

CONTAINER SHAKING DEVICE

BACKGROUND OF THE INVENTION

1. Field of the Invention

The present invention relates to container shaking devices, and more particularly pertains to a new and improved container shaking device particularly adapted for shaking finger nail polish containers prior to use. Presently, individuals must manually shake nail polish containers prior to use for a protracted period of time. To eliminate this inconvenience, the present invention provides an automatic electric shaking device particularly adapted for securing and shaking nail polish containers of various different sizes.

2. Description of the Prior Art

Various types of container shaking devices are known in the prior art. A typical example of such a container shaking device is to be found in U.S. Pat. No. 3,735,962, which issued to H. Pagano on May 29, 1973. This patent discloses a jar shaker which includes an electric motor connected for driving a flywheel connected by an offset crank to a jar receiving structure free to move within a housing within limits defined by a restraining spring. The jar receiving structure is adjustable to receive and hold different sizes of jars. A timer controls duration of shaking movement. U.S. Pat. No. 4,134,689, which issued to B. Ahrenskou-Sorensen on Jan. 16, 1979, discloses a mixing apparatus for liquid material within a can. An inner frame includes a table for supporting the can and a clamp for securing the can on the table. The inner frame is arranged for vibration relative to an outer frame. An electric motor mounted on the outer frame drives the inner frame by way of a transmission system including a screw-nut assembly. A remote control system is provided for automatic sequential and controlled operation of the device during clamping, shaking and releasing of a can. U.S. Pat. No. 4,173,418, which issued to W. Vork on Nov. 6, 1979, discloses a device for mixing liquids such as paints in closed containers, including a motor drive unit coupled to a drive pulley to produce a constant rotational speed. The drive pulley is connected via an eccentric crank to a shaker plate which has mounted therein a container housing, the shaker plate being also supported from at least two other points by similar crank couplings so as to produce a circular oscillating motion when the drive motor is actuated. U.S. Pat. No. 4,445,782, which issued to Sparrow, Jr. on May 1, 1984, discloses a paint container shaker which includes a U-shaped holder supported within a housing and having clamping discs for detachably securing paint containers thereto. The U-shaped holder is mounted for rotation on a drive shaft horizontally received in the housing. U.S. Pat. No. 4,497,581, which issued to H. Miller on Feb. 5, 1985, discloses a paint shaker having an open ended bucket for receiving a paint container. A yoke supports the bucket and is mounted to rotate around a vertical axis which intersects the central longitudinal axis of the bucket at an intersection point. A motor is provided for simultaneously rotating the bucket and the yoke.

While the above mentioned devices are suited for their intended usage, none of these devices are suitable for clamping and shaking a nail polish container. Additionally, none of the above devices disclose a nail polish holder secured on a pivotal arm driven by an elongated reciprocating arm having a slotted portion receiving a transverse pin of a rotary arm for providing a jerking oscillating shaking action for effectively mixing nail polish. The present invention additionally discloses a novel nail polish container clamping mechanism which is adaptable for securing various different sizes of nail polish containers. Inasmuch as the art is relatively crowded with respect to these various types of container shaking devices, it can be appreciated that there is a continuing need for and interest in improvements to such container shaking devices, and in this respect, the present invention addresses this need and interest.

SUMMARY OF THE INVENTION

In view of the foregoing disadvantages inherent in the known types of container shaking devices now present in the prior art, the present invention provides an improved container shaking device. As such, the general purpose of the present invention, which will be described subsequently in greater detail, is to provide a new and improved container shaking device which has all the advantages of the prior art container shaking devices and none of the disadvantages.

To attain this, a representative embodiment of the concepts of the present invention is illustrated in the drawings and makes use of a container shaking device especially for use in shaking nail polish containers which includes a container holding portion mounted on a pivotal arm. An elongated reciprocal bar has a first end secured for pivoting the pivotal arm and has an elongated slot formed adjacent an opposite end. A rotary arm has a transverse pin received in the slot on the reciprocal arm and is connected through a plurality of gears for rotation by an electric motor. The container holder includes an L-shaped portion having a first leg secured to the pivotal arm and a clamping member mounted for sliding movement on the first leg member in parallel relation with a second leg member. A spring biased clamping pin is utilized for securing the clamping member in adjusted position for securing various different sizes of containers.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container shaking device which has all the advantages of the prior art container shaking devices and none of the disadvantages.

It is another object of the present invention to provide a new and improved container shaking device which may be easily and efficiently manufactured and marketed.

It is a further object of the present invention to provide a new and improved container shaking device which is of a durable and reliable construction.

An even further object of the present invention is to provide a new and improved container shaking device which is susceptible of a low cost of manufacture with regard to both materials and labor, and which accordingly is then susceptible of low prices of sale to the consuming public, thereby making such container shaking devices economically available to the buying public.

Still Yet another object of the present invention is to provide a new and improved container shaking device which provides in the apparatuses and methods of the prior art some of the advantages thereof, while simultaneously overcoming some of the disadvantages normally associated therewith.

Still yet another object of the present invention is to provide a new and improved container shaking device which is particularly adapted for holding and shaking various different sizes of nail polish containers.

Yet another object of the present invention is to provide a new and improved container shaking device which provides an oscillatory jerking shaking action to a supported nail polish container.

Even still another object of the present invention is to provide a new and improved container shaking device having an L-shaped holding member supporting a slidable clamping member for securing various different sizes of nail polish containers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
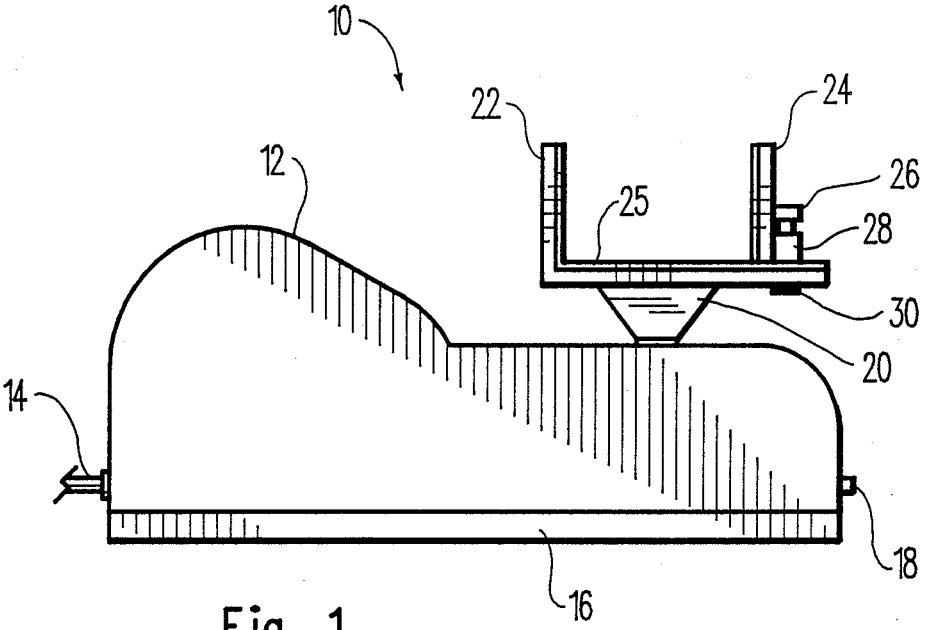
FIG. 1 is a side view view of the container shaking device of the present invention.

With reference now to the drawings, and in particular to FIG. 1 thereof, a new and improved container shaking device embodying the principles and concepts of the present invention and generally designated by the reference numeral 10 will be described.

More specifically, it will be noted that the first embodiment 10 of the invention includes a housing 12 including a power cord 14 adapted for connection with a conventional AC power source. A switch 18 is provided for actuating and de-actuating the internal shaking mechanism. The housing 12 includes a planar bottom surface 16 adapted for support on the surface of a table or counter. The upper end 20 of a pivotal arm extends through a slot formed in an upper surface of the housing 12 and is secured to a L-shaped container holding member having a first vertical leg portion 22 and a second horizontal leg portion 25. A clamping member 24 is slidably mounted on the horizontal leg portion 25 in spaced parallel relation from the vertical leg portion 22. A frictional clamping mechanism is provided for securing the clamping member 24 in a selected adjusted position and includes an axially movable shaft having an enlarged head portion 30 extending through a slot formed in the horizontal leg member 25. The shaft extends through a cylindrical well 28 and has an upper end including a lateral projection on a head 26 received in a vertically extending groove formed in a face of the clamping member 24.

Figure 2:
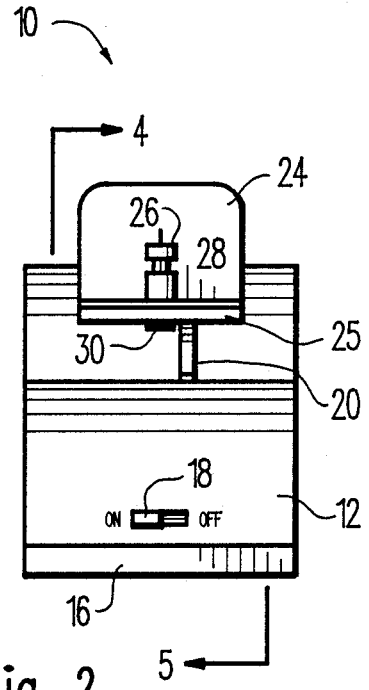
FIG. 2 is a front end view of the container shaking device.

FIG. 2 illustrates an end view of the container shaking device 10.

Figure 3:
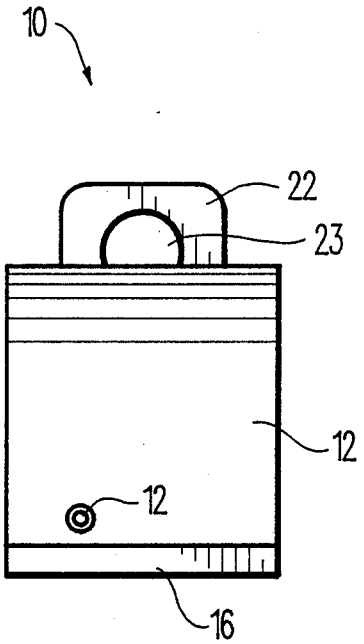
FIG. 3 is a back end view of the container shaking device.

FIG. 3 illustrates an opposite end view of the container shaking device which illustrates a circular aperture 23 formed centrally through the vertical leg portion 22 of the container holding member. The aperture 23 is adapted to receive the neck portion of a conventional nail polish container.

Figure 4:
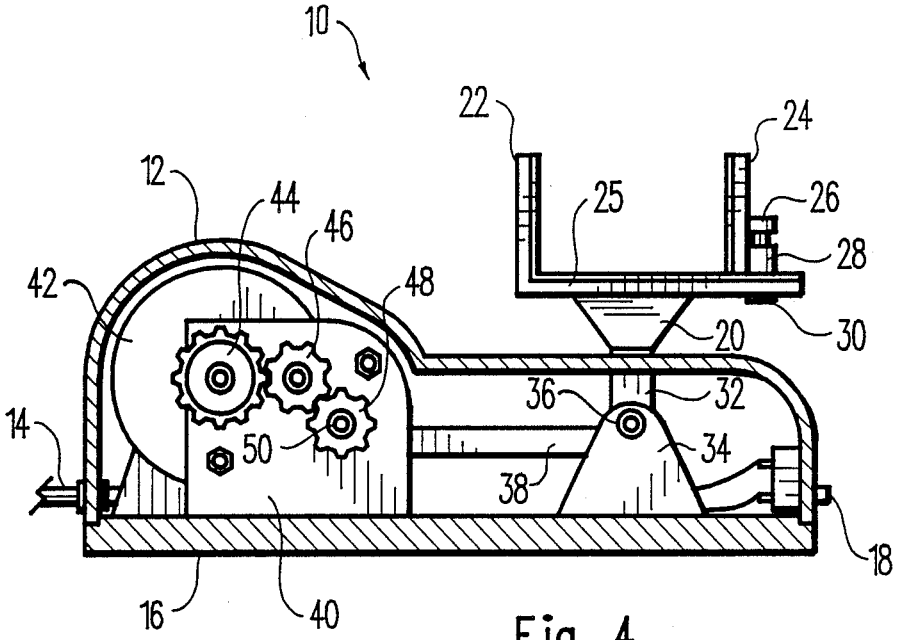
FIG. 4 is a cross sectional view, taken along line 4 of FIG. 2.

FIG. 4 is a cross sectional view, taken along line 4 of FIG. 2 which illustrates the internal shaking mechanism. A lower portion 32 of the pivotal arm 20 is secured to a support member 34 by a pivot pin 36. An elongated reciprocating arm 38 is pivotally secured to an extreme lower end portion of the pivotal arm 32. A support member 40 mounts a plurality of gears 44, 46, and 48 which transmit the rotary motion of the output shaft of an electric motor 42 to an increased speed drive shaft 50.

Figure 5:
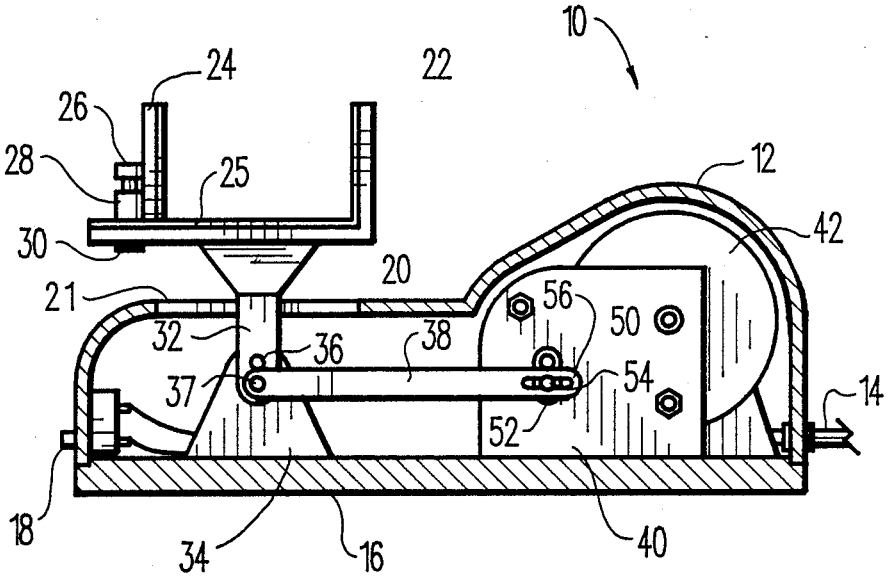
FIG. 5 is a cross sectional view, taken along line 5 of FIG. 2.

As illustrated in FIG. 5, the drive shaft 50 is secured to and rotates a rotary arm 52. The rotary arm 52 includes a transversely extending pin 54 received within an elongated slot 56 formed in the reciprocating arm 38. The opposite end of the arm 38 is pivotally secured by a pin 37 to an extreme lower end of the pivot arm 32. Thus, upon rotation of the arm 52, the pin 54 will reciprocate within the slot 56 and upon reaching either extreme end portion of the slot 56 will impart a jerking reciprocating motion to the arm 38. This motion in turn will reciprocate the pivot arm 20 pivotally in opposite directions, and thus impart a jerking, oscillating pivotal motion to the container holding member 25. It should be noted that the length of the slot 56 may be adjusted to regulate the degree of travel of the pivotal arm 20. The pivotal arm 32 extends through a slot 21 in the upper surface of the housing 12.

Figure 6:
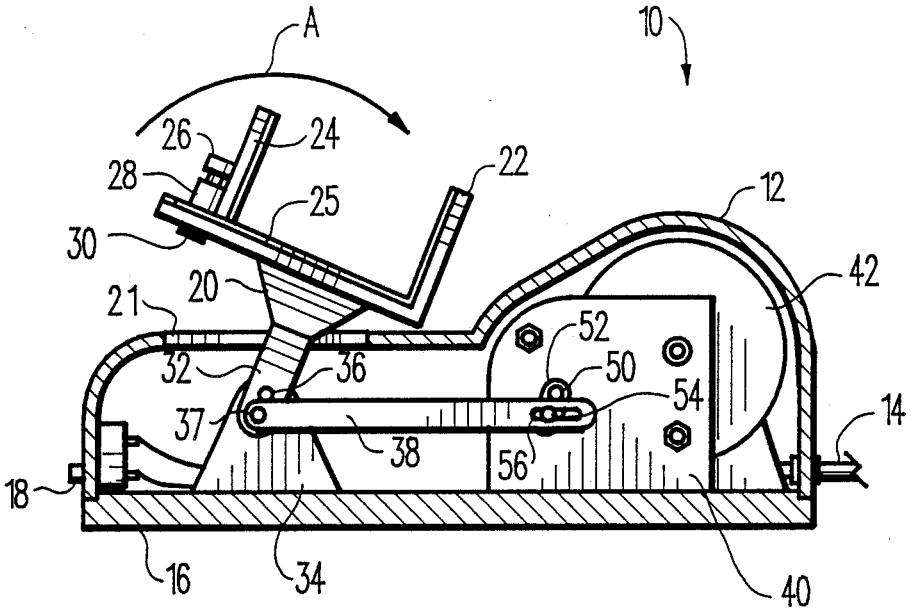
FIG. 6 is a cross sectional view, illustrating the manner of operation of the shaking mechanism.

FIG. 6 illustrates the pin 54 connected to the arm 52 moving away from the left hand end of the slot 56. The container holding member 25 has thus been moved as indicated by arrow A to the extreme right hand position.

Figure 7:
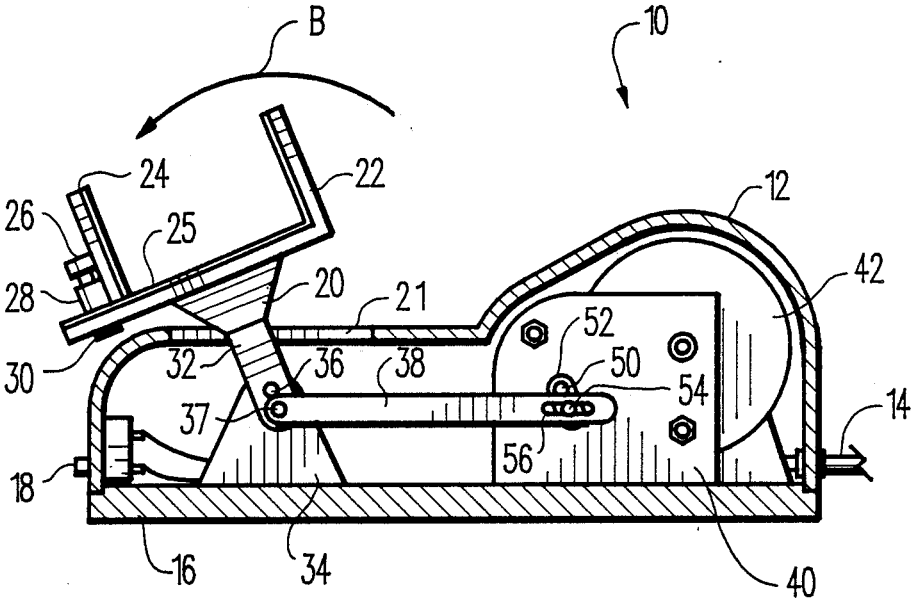
FIG. 7 is a cross sectional view, further illustrating the manner of operation of the shaking mechanism.

FIG. 7 illustrates the container holding member 25 in a position of movement in an extreme left hand position.

Figure 8:
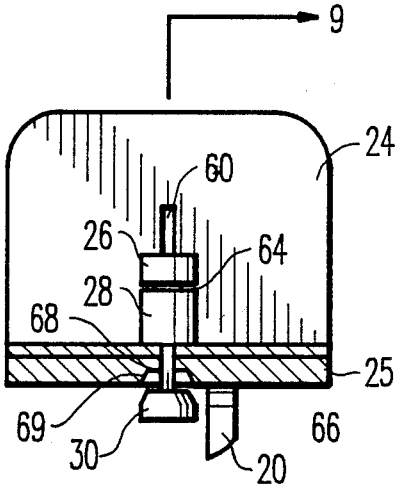
FIG. 8 is an enlarged detail view, illustrating the nail polish container clamping mechanism.

FIG. 8 illustrates a detail view, partially in cross section, which illustrates the mechanism for securing the clamping member 24 in an adjusted position with respect to the stationary holding member horizontal leg portion 25. A longitudinal slot extends centrally through the holding member leg portion 25 and includes an upper straight wall portion 68 and a lower tapered wall portion 69. An axially movable shaft 66 has a lower enlarged head portion 30 which includes an upper frusto conical tapered portion dimensioned for frictional engagement in the tapered slots 69. The axially movable shaft 66 is received through a cylindrical well 28 secured to the clamping member 24 and has an upper portion 64 terminating in an upper head 26. An elongated groove 60 is formed centrally on the clamping member 24 and extends transversely to the slot 68. A lateral projection 62 is formed on the upper head portion 26 of the shaft 66 and is received for axial movement within the slot 60. The slot 60 is preferably dovetailed or has a T slot configuration which secures the shaft 66 against transverse movement relative to the clamping member 24.

Figure 9:
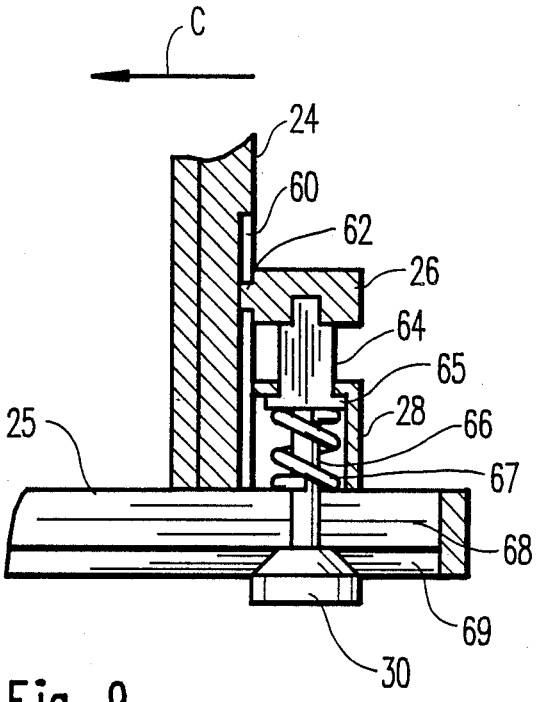
FIG. 9 is a cross sectional view, taken along line 9 of FIG. 8, further illustrating the construction of the nail polish container clamping mechanism.

As shown in the cross sectional view of FIG. 9, the shaft 66 has a radial flange 65 captured within the cylindrical well 28. A coil spring 67 surrounds the shaft 66 and has a first end in abutment with the upper surface of the container holding member leg portion 25 and an opposite end in abutment with the radial flange 65. The upper portion of the shaft 64 is rigidly secured to an upper head portion 26 having a lateral projection 62 received for longitudinal sliding movement within the groove 60 formed in the clamping member 24. As previously described, the lateral projection 62 and groove 60 preferably have a cooperating dovetail configuration or a T slot configuration which constrains the projection 62 and attached shaft 66 against lateral movement relative to the clamping member 24. In use, upon release of the head portion 30, the clamping member 24 may be moved in the direction indicated by arrow C for engagement with various different sizes of nail polish containers. The tapered enlarged head portion 30 of the shaft 66 may be released from frictional clamping engagement with the tapered slotted portion 69 by depressing the upper head portion 26 by the thumb of an individual. Upon adjustment of the clamping member 24 to a desired location, the upper head portion 26 is released and the tapered head portion 30 returns to frictional clamping engagement with the tapered slotted portion 69.

Figure 10:
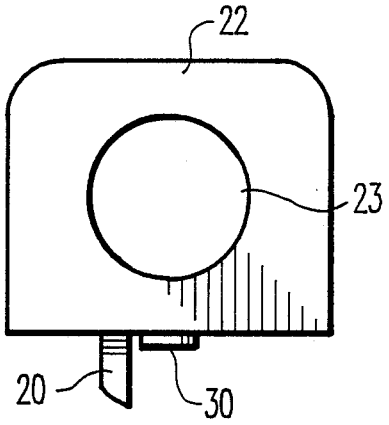
FIG. 10 is a detail view, illustrating a portion of the nail polish container holding mechanism.

FIG. 10 illustrates a detail view of the vertical leg portion of the container holding member 22. In use, the reduced diameter neck and cap portion of a conventional nail polish container is inserted through the central circular aperture 23. The clamping member 24 (FIG. 1) is then adjusted into abutment with the bottom surface of the container, utilizing the mechanism described in FIG. 9. Thus, the container holding mechanism provides an extremely rapid clamping mechanism which is adaptable for use with a wide variety of differently sized containers. Through the use of the apparatus of the present invention, an individual may conveniently and rapidly mix the contents of a nail polish bottle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A container shaking device, comprising:

container holding means, said container holding means including an L-shaped member having a first leg portion and a second leg portion provided with an aperture for receiving a container neck;

a pivotal arm secured to said first leg portion of said container holding means;

an elongated reciprocal bar having a first end secured for pivoting said pivotal arm;

an elongated slot formed adjacent an opposite end of said reciprocal bar;

a rotary arm having a transverse pin received in said slot; and means for rotating said rotary arm.

2. The container shaking device of claim 1, wherein said means for rotating said rotary arm comprises an electrical motor.

3. The container shaking device of claim 2, further comprising gear means operatively connected between a rotary output shaft of said motor and said rotary arm for increasing the rotation speed of said rotary arm.

4. The container shaking device of claim 1, further comprising a clamping member slidably mounted on said first leg member in parallel relation with said second leg member.

5. The container shaking device of claim 4, further comprising means for securing said clamping member in adjusted position.

6. The container shaking device of claim 5, wherein said securing means comprises:

a slot formed through said first leg portion, said slot having a straight wall portion and a connected tapered wall portion;

an elongated shaft extending through said slot;

an enlarged head formed on said shaft, said enlarged head having a tapered portion dimensioned for frictional engagement with said tapered wall slot portion;

an end portion of said shaft mounted for limited axial movement and constrained against relative movement transverse to said shaft with respect to said clamping members; and spring means biasing said tapered portion of said enlarged head into frictional clamping engagement with said tapered wall portion of said slot.

7. The container shaking device of claim 6, further comprising:

a cylindrical well secured to said clamping member, said shaft extending axially through said well;

a radial flange on said shaft within said well;

a coil spring surrounding said shaft and having a first end in abutment with said first leg portion of said L-shaped member and a second end in abutment with said radial flange;

a lateral projection on an end of said shaft opposite said enlarged head;

an undercut groove formed in said clamping member, said groove extending transversely to said slot; and said lateral projection received in said groove for axial movement and constrained against transverse movement relative to said shaft.

* * * * *